United States Patent [19]

Hirano et al.

[11] 4,386,564

[45] Jun. 7, 1983

[54] SERIAL PRINTER

[75] Inventors: Seiichi Hirano; Toshiaki Ooshima, both of Shiojiri, Japan

[73] Assignee: Epson Corporation, Nagno, Japan

[21] Appl. No.: 234,068

[22] Filed: Feb. 12, 1981

[30] Foreign Application Priority Data

Feb. 14, 1980 [JP] Japan ..... 55-17004

[51] Int. Cl.[3] ..... B41J 1/16

[52] U.S. Cl. ..... 101/93.15; 400/328

[58] Field of Search ..... 101/93 R, 93.15, 93.16, 101/93.17; 400/320, 323, 328, 119, 120, 578

[56] References Cited

U.S. PATENT DOCUMENTS

| | | | |
|---|---|---|---|
| 950,473 | 3/1910 | Campbell et al. | 101/93.17 X |
| 2,578,771 | 12/1951 | Zint | 400/328 X |
| 3,599,772 | 8/1971 | Comstock | 101/93.16 X |
| 3,628,645 | 12/1971 | McFeaters et al. | 101/93.15 X |
| 3,651,916 | 3/1972 | Becchi | 101/93.17 X |
| 3,688,691 | 9/1972 | Vol et al. | 101/93.16 |
| 3,935,938 | 2/1976 | Hodne | 400/328 X |
| 3,972,280 | 8/1976 | Swatik et al. | 101/93.16 |
| 4,050,569 | 9/1977 | Crump et al. | 400/328 X |
| 4,123,182 | 10/1978 | Kondur, Jr. | 101/93.15 X |
| 4,167,345 | 9/1979 | Englund et al. | 400/328 X |

OTHER PUBLICATIONS

Lingle, "Typewriter Drive Transmission", IBM Tech. Discl. Bulletin, vol. 13, No. 9, Feb. 1971, p. 2727.

*Primary Examiner*—E. H. Eickholt

*Attorney, Agent, or Firm*—Blum, Kaplan, Friedman, Silberman and Beran

[57] ABSTRACT

A serial printer wherein a print head is reversibly displaced transverse to a print medium by an open looped grooved rotating cylindrical cam is provided. A unidirectional drive shaft is operatively coupled to the cam by a drive gear engaged with planet gears mounted on a clutched rotary member for rotating the cam when the rotary member is stationary. An intermediate gear is intermittently engaged with the drive gear for changing the rotating direction of the cam upon engagement of the intermediate gear between the drive gear and planet gear. The rotary member includes geared regions adapted to be engageable with a print medium advancing assembly for advancing the recording medium during rotation of the rotary member when the drive of the print head is stopped and the direction of the cylindrical cam is about to be reversed. Advancing the print medium during change of direction of the print head when the cam is not being driven reduces the load placed on the motor, thereby permitting reduction in power consumption.

22 Claims, 8 Drawing Figures

FIG. 1
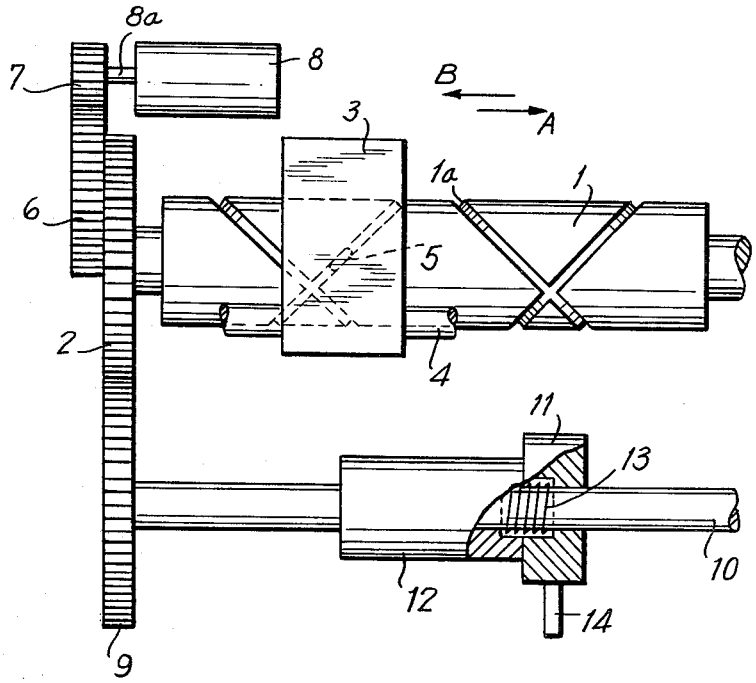
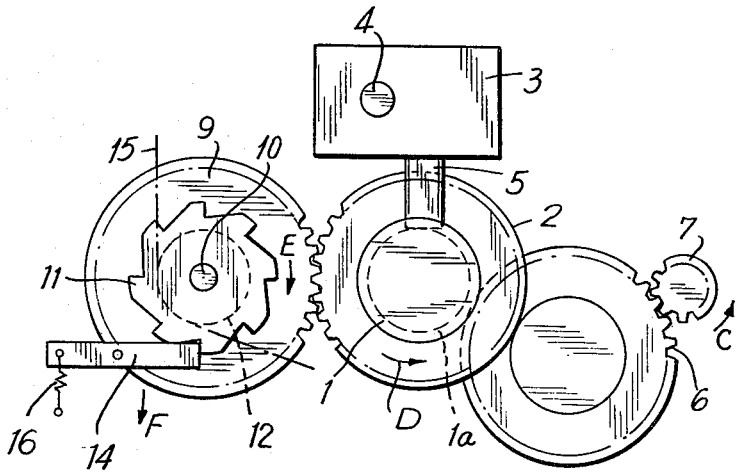
FIG. 2

FIG.3
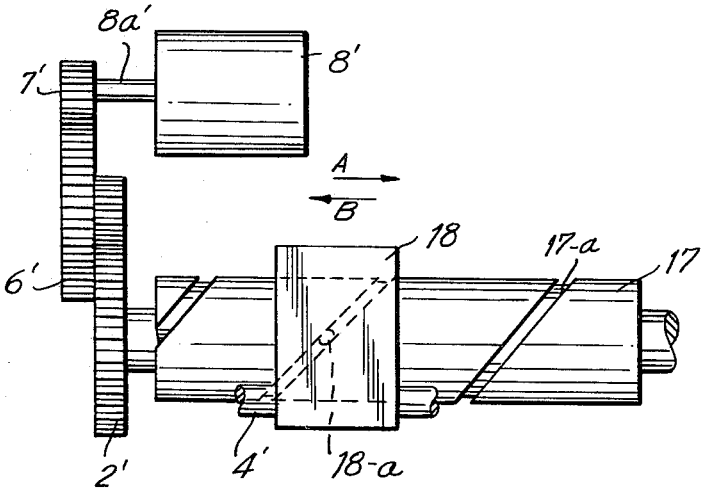
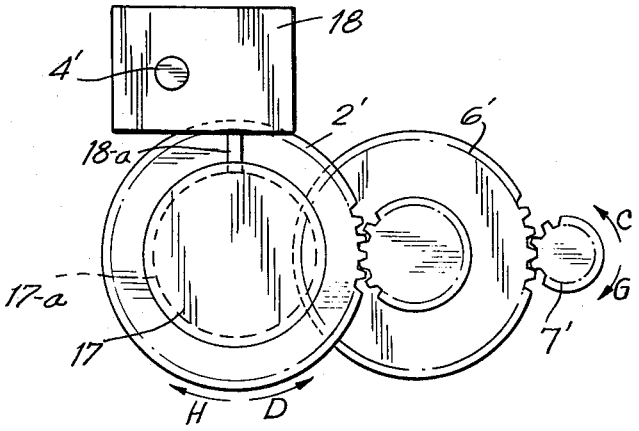
FIG.4

SERIAL PRINTER

BACKGROUND OF THE INVENTION

This invention relates generally to a printer, and particularly to a miniaturized serial printer wherein a print head is adapted to be displaced reversibly across a recording medium. In conventional serial printers, a print head is reversibly displaced across the recording medium by rotating a cylindrical cam. The cylindrical cam may include a closed loop spiral groove and the print head support includes a projection for following the closed loop sprial groove, in camming like fashion. The cam is rotated in one direction and displacement of the print head occurs as the print head follows the closed loop.

Alternatively, a conventional serial printer may include a cylindrical cam having an open loop spiral groove wherein the direction is reversed by reversing the rotating direction of the cylindrical cam. The print head support in this construction also includes a projection for following the groove in camming like fashion. Displacement of the print head is reversed by reversing the rotating direction of the cylindrical cam. This reversal is usually accomplished by a two directional motor.

In both types of conventional serial printers, the recording medium is advanced by a mechanical or electrical trigger driven by the printer motor. Both types of cylindrical cams always rotate while the motor rotates thereby displacing the print head. Thus, recording medium advancing also occurs while the print head is being displaced. For this reason, loads due to print medium advancing and displacing the print head are placed on the motor simultaneously. Accordingly, it is difficult to reduce the power consumption of the motor. Such operation also is a principal cause of mechanical problems as the print medium advancing mechanism tends to jam or the print medium tends to feed improperly. Additionally, the distance which the print head must be reversibly displaced includes the print range and an additional distance for the print medium advancing operation. Thus, the print heads are required to be displaced at a greater distance than merely the print range or margin. This latter point has been an obstacle to further miniaturization of serial printers.

An example of a serial printer including a rotating cylindrical cam having a closed helical groove in the form of a continuous loop is shown in U.S. Pat. No. 4,046,246. An alternative type of rotating cam is a rotating disc as shown in U.S. Pat. No. 4,175,876 issued to Seiji Hanaoka on Nov. 27, 1979 and assigned to the same assignees as the subject application. In the Hanaoka printer, the rotating disc drives the various mechanisms of the printer, including the print head and print tape advancing assembly.

A cylindrical cam having a closed loop spiral groove is generally expensive to prepare. Alternatively, utilizing an open loop requires a more complex driving circuit in combination with a reversible motor in view of the need to reverse the direction of the rotation of the cam. This raises additional obstacles to reduction in manufacturing costs for a serial printer. Additionally, a reversible motor necessarily involves increased power consumption. Furthermore, when using a DC motor, the large power consumption generally leads to a decrease in the lifetime of the motor brushes. Accordingly, it would be desirable to provide a construction for a serial printer including a unidirectional motor and cylindrical cam having an open loop groove for displacing the print head.

SUMMARY OF THE INVENTION

Generally speaking, in accordance with the invention, a serial printer including a print head adapted for reversible transverse displacement across a print medium for effecting printing in at least one direction is provided. The printer includes a unidirectional drive for reversibly driving a cylindrical cam having an open loop groove for reversibly displacing a print head operatively engaged in camming fashion with the open loop groove. A print head includes a depending projection adapted to engage the open loop groove in camming fashion for displacing the print head across the print medium. A drive shaft rotates in only one direction and is selectively operatively engaged to the cam for rotating the cam by a rotary clutch assembly.

The clutch assembly includes a clutch plate fixedly mounted on the drive shaft and a rotary member rotatably mounted on the drive shaft. A clutch lever is intermittently engageable with the clutch plate for intermittently rotating the rotarty member. The rotary member includes a pair of rotatably mounted planet gears for transmitting rotation of the drive shaft through a first gear to the cylindrical cam. An intermediate gear is also mounted on the rotary member and engaged with one of the planet gears for rotating the first gear in an opposite direction than when rotated by the other planet gear.

The clutch lever is held out of engagement by a change lever until the print head completes displacement and then engages the clutch plate for rotating the rotary member. At this time, the rotating rotary member actuates a printing medium advancing member. As the rotary member continues to rotate, the clutch lever is disengaged from the clutch plate by the change lever when the second planet gear engages the first gear for driving the cylindrical cam in the opposite print direction.

The clutch assembly is disengaged at the end of a print displacement of the print head. This stops rotation of the cam and permits print medium advance with reduced load on the drive motor. Accordingly, of conventional serial printers are overcome by utilizing a unidirectional drive in combination with a cylindrical cam having an open loop groove.

Accordingly, it is an object of the invention to provide an improved printer.

Another object of the invention is to provide an improved printer wherein a print head is adapted to be reversibly displaced across a print medium for printing in each direction.

A further object of the invention is to provide an improved printer suitable for miniaturization.

Still another object of the invention is to provide an improved printer wherein a print head is displaced in rectilinear reciprocating motion without utilizing a two directional motor.

Still a further object of the invention is to provide an improved serial printer of reduced power consumption.

Another object of the invention is to provide an improved printer wherein the likelihood of interruptions caused by the print medium advancing is reduced.

A further object of the invention is to increase the printing speed of a serial printer.

Yet another object of the invention is to provide a serial printer wherein the print head is reversibly displaced by and open looped cylindrical cam in a unidirectional drive.

Yet a further object of the invention is to provide an improved serial printer wherein the distance the print head is displaced is reduced.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view of a drive mechanism for a serial printer including a unidirectional motor and closed loop-grooved cylindrical cam;

FIG. 2 is a side elevational view of the drive mechanism for a printer as illustrated in FIG. 1;

FIG. 3 is a plan view of a drive mechanism for a serial printer including a two directional motor and open loop spiral-grooved cylindrical cam;

FIG. 4 is a side elevational view of the drive mechanism for a printer as illustrated in FIG. 3;

DESCRIPTION OF THE PREFERRED EMBODIMENTS

Figure 5:
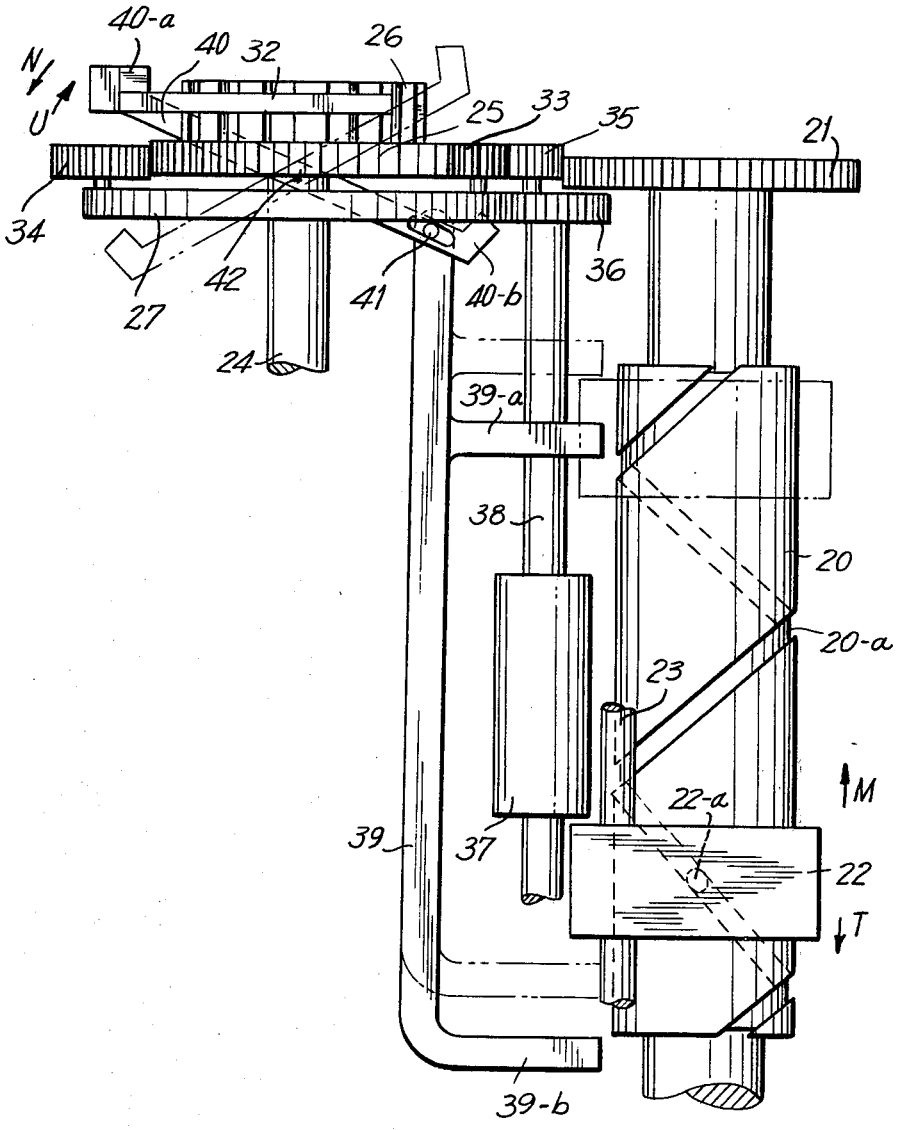
FIG. 5 is a plan view of the drive mechanism for a serial printer including a unidirectional drive shaft and open loop-grooved cylindrical cam constructed and arranged in accordance with the invention.

Referring now to FIGS. 1 and 2, the mechanism for driving a print head and paper advancing mechanism in a serial printer wherein printing occurs during the reversible rectilinear displacement of the print head is shown. A cylindrical cam 1 having a spiral groove in a closed loop 1*a* and a cam gear 2 fixedly mounted at one end thereof is supported on a printer frame (not shown). A guide shaft 4 is mounted on the printer frame adjacent to and parallel to cylindrical cam 1 and supports a print head 3 slideably mounted thereon. Print head 3 includes a projection 5 adapted to engage spiral groove 1*a* on cylindrical cam 1 in camming like fashion.

A motor 8 rotates a motor shaft 8*a* in one direction only. A motor gear 7 is mounted on motor shaft 8*a*. A reduction gear 6 is rotatably mounted on the printer frame and engaged with motor gear 7. A paper feed gear 9 is fixedly supported on a paper feed shaft 10 for advancing a print paper 15 through the printer. The ratchet 11, a paper feed roller 12 and a torsion spring 13 are mounted on shaft 10. Shaft 10, ratchet 11, paper feed roller 12 and torsion spring 13 constitute a spring clutch mechanism for advancing recording paper 15 as a trigger lever 14 engaged with ratchet 11 is intermittently released in a direction F to disengage from ratchet 11 as will be described in more detail below in connection with operation of the drive mechanism.

In the drive mechanism illustrated in FIGS. 1 and 2, motor 8 always rotates in the direction of arrow C. Rotation in direction of arrow C is transmitted to cam gear 2 by motor gear 7 which also rotates in direction C. Reduction gear 6 rotates in an opposite direction to motor gear 7 and cylindrical cam 1 thereby rotates in a direction of arrow D, which in this case is the same direction as arrow C. As cylindrical cam 1 is rotated in arrow direction D, print head 3 is reversibly displaced rectilinearly in arrow directions A and B as projection 5 follows spiral groove 1A in camming like fashion. Printing on recording paper 15 occurs as print head 3 is displaced in arrow direction A or B. As print head 3 is displaced, paper feed shaft 10 is rotated in arrow direction E by motor gear 7 engaged with reduction gear 6, cam gear 2 and paper feed gear 9.

There comes a time when print head 3 is displaced out of a printing range or into the margin of print paper 15. The printing range is the distance within which print head 3 prints on print paper 15. After print head 3 is displaced out of the printing range in the direction of either arrow A or B, trigger lever 14 is rotated either mechanically or electrically in the direction of arrow F against a spring 16. This displacement of trigger lever 14 releases ratchet 11 from engagement with trigger lever 14 thereby permitting paper feed roller 12 to rotate in the direction of arrow E through torsion spring 13 by a given amount until the next tooth of ratchet 11 engages with trigger lever 14 which has been returned to its rest position by the biasing force of spring 16. During the time paper feed roller 9 has rotated, print paper 15 is advanced.

Referring now to FIGS. 3 and 4, a drive mechanism for a serial printer wherein a cylindrical cam 17 includes a spiral groove in open looped configuration 17*a* is shown. A print head 18 includes a projection 18*a* which engages spiral groove 17*a* in camming like fashion and in the same manner as print head 3 and projection 5 engage spiral groove 1*a* in the mechanism illustrated in FIGS. 1 and 2. The remaining component parts in the drive mechanism illustrated in FIGS. 3 and 4 remain the same as in the mechanism illustrated in FIGS. 1 and 2. Accordingly, like elements are identified by the same reference numerals primed.

When a two directional motor 8' is rotated in the direction of arrow C, cylindrical cam 17 is rotated in the direction of arrow D and print head 18 is displaced in the direction of arrow A as projection 18*a* follows groove 17*a*. As print head 18 is displaced, printing occurs on a print medium. When print head 18 is displaced in arrow direction A so as to be out of the printing range, the paper feed mechanism (not shown), which may be of the type utilizing a trigger as illustrated in FIGS. 1 and 2, advances the recording paper. After the recording paper has been advanced, the direction of motor 8' is reversed to direction G and cylindrical cam 17 is rotated in the direction of arrow H. When cylindrical cam 17 is rotated in the direction of arrow H, print head 18 is displaced in the direction of arrow B for printing on the recording medium in this opposed direction.

The drive mechanisms of the printers described in FIGS. 1–4 are not completely satisfactory. Firstly, in each case cylindrical cams 1 and 17 are rotated continuously as motors 8 and 8′ are rotated for displacing print heads 3 and 18 in the direction of arrows A or B during the paper advancing operation. For this reason, the loads due to both paper advancing and displacement of print heads are placed on the motors simultaneously, making it difficult to reduce the power consumption for the motor. Such operation is often the main reason for problems in connection with paper advancing, such as paper jams and wandering of the paper, and the like. Additionally, the distance print heads 3 and 18 are reversibly displaced includes both the printing range and an additional distance into the margin for performing the paper advancing operation. Thus, print heads 3 and 18 are required to be displaced a distance greater than merely the printing range. Such additional distance prevents additional miniaturization of serial printers constructed and arranged in accordance with these constructions.

The second shortcoming of these constructions is the manufacturing cost. A cylindrical cam having a spiral groove of the closed loop type as illustrated in the drive mechanism of the printer in FIGS. 1 and 2 is expensive to manufacture. Additionally, the drive mechanism of the printer illustrated in FIGS. 3 and 4 include a driving circuit which is expensive since the motor is rotated in a forward and reverse direction. Both factors are obstacles to reducing the manufacturing costs in either the printer of the type in FIGS. 1 and 2 or the printer of the type in FIGS. 3 and 4. Additionally, in the drive mechanism of the printer illustrated in FIGS. 3 and 4 power consumption is increased when the motor is reversed. Further, when using a DC motor, this large power consumption often causes a further problem as it decreases the useful life of the motor brush.

Figure 6:
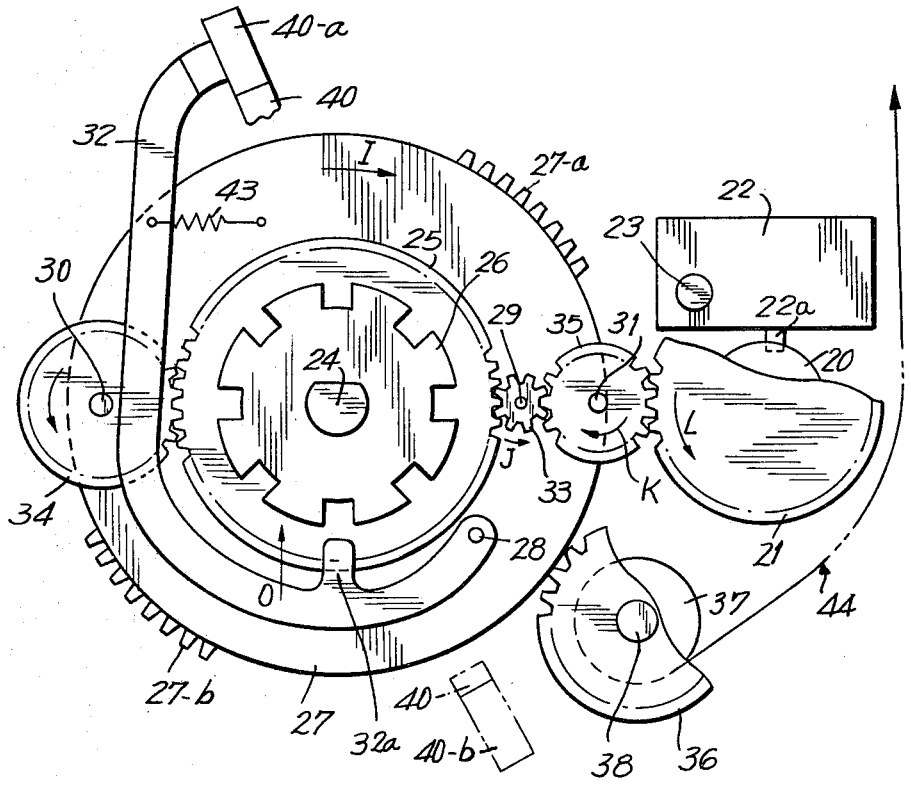
FIG. 6 is a side elevational view of the drive mechanism for a serial printer as illustrated in FIG. 5 including a rotary member shown in a first print head drive position.

Referring now to FIGS. 5–8, the drive mechanism for a printer constructed and arranged in accordance with a preferred embodiment of the invention which overcomes many of the shortcomings is shown. Referring specifically to FIGS. 5 and 6, a cylindrical cam 20 having a spiral groove 20*a* of the open loop configuration is shown. A cam gear 21 is mounted at one end of cylindrical cam 20. A print head 22 is slideably mounted on a guide shaft 23 and includes a projection 22*a* adapted to engage spiral groove 20*a*.

Cylindrical cam 20 is driven by a drive shaft 24 which is rotated in one direction only by a drive source (not shown). A drive gear 25 is mounted at the drive end of drive shaft 24 and a clutch plate 26 is also fixedly mounted on drive shaft 24 adjacent to drive gear 25. A change wheel 27 which functions as a rotary member is rotatably mounted on drive shaft 24 and includes a first gear portion 27*a* and a second gear portion 27*b* on the periphery thereof with an integral between the gear portions of 180°. A plurality of pins 28, 29, 30 and 31 are mounted on change wheel 27.

Figure 7:
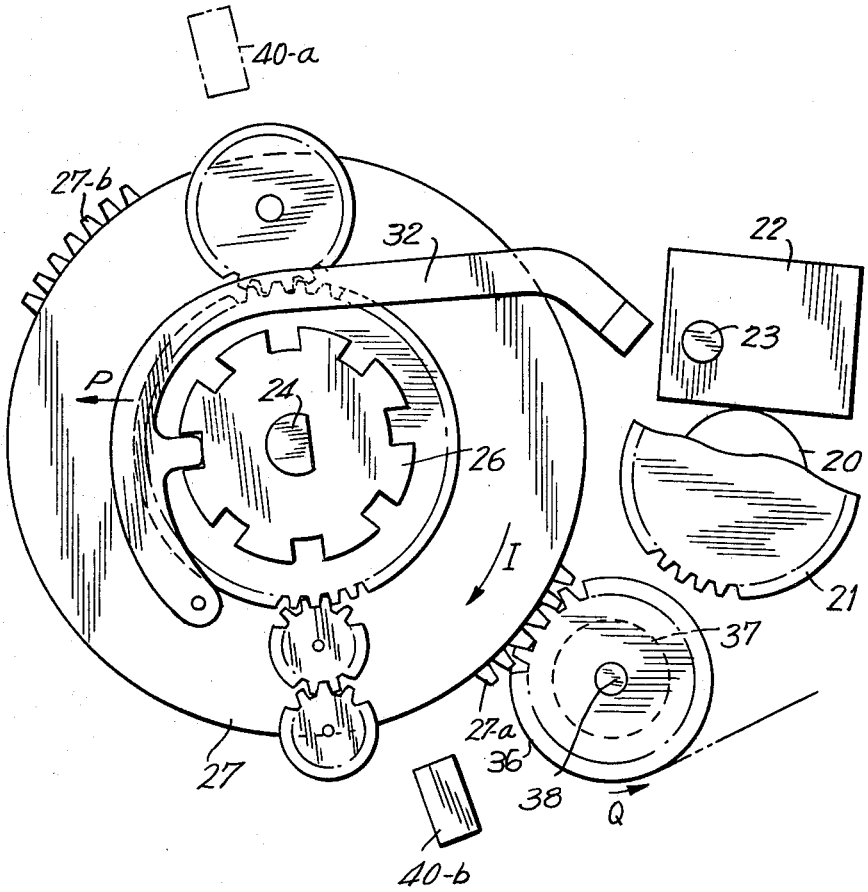
FIG. 7 is a side elevational view of the drive mechanism illustrated in FIGS. 5 and 6 wherein the rotary member is rotated approximately 90° and is in a print medium advancing operation with the cylindrical cam stopped.

A clutch lever 32 including an engaging tooth 32*a* is mounted on pin 28. Clutch lever 32 is free to be rotated about pin 28 from a first position out of engagement with clutch plate 26 as shown in FIG. 6 and a second engaged position as shown in FIG. 7. A small planet gear 33 is mounted on pin 29 which is always rotated by engagement with drive gear 25. A second large planet gear 34 is mounted on pin 30 which is always rotated by its engagement with drive gear 25. Large planet gear 34 is dimensioned to be engageable with cam gear 21. An intermediate gear 35 is mounted on pin 31 and is always rotated by its engagement with small planet gear 33 which, in turn, is engageable with drive gear 25. Intermediate gear 35 is dimensioned to be engageable with cam gear 21 for driving cylindrical cam 20.

Figure 8:
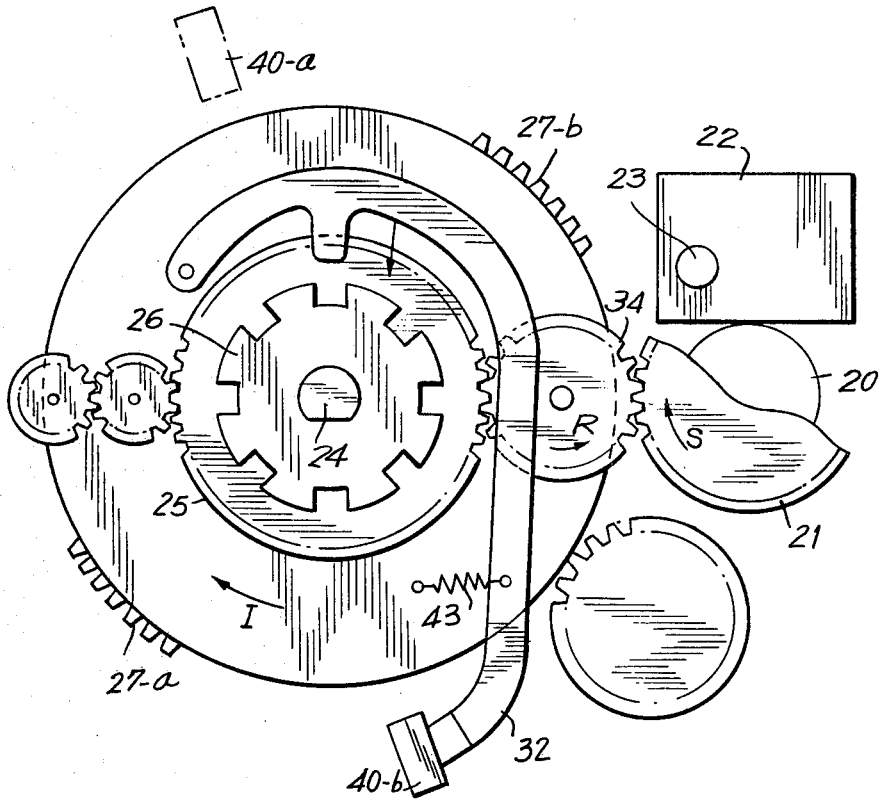
FIG. 8 is a side elevational view of the drive mechanism illustrated in FIGS. 5–7 wherein the rotary member has been rotated a further 90° from the position illustrated in FIG. 7 and is shown in a second rotary cam drive position.

The paper advancing assembly of the drive assembly, illustrated in FIGS. 6–8, includes a paper feed gear 36 which is fixedly mounted on a paper feed shaft 38 which is rotatably supported in the printer frame (not shown). A paper feed roller 37 is also mounted on paper feed shaft 38. Paper feed roller 37 is intermittently rotated a fixed amount by intermittent engagement with first gear portion 27*a* and second gear portion 27*b* of change wheel 27 when change wheel 27 is rotated as will be described in more detail in connection with operation of the drive mechanism.

Referring now to FIG. 5, an elongated change lever 39 having a first engaging arm 39*a* and a second engaging arm 39*b* is arranged so that first and second engaging arms 39*a* and 39*b* are engaged by print head 22 as it approaches the end of travel in a print direction. Change lever 39 is mounted for displacement in the two directions of travel of print head 22 and is pivotally engaged through a pin 41 to an engagement lever 40 which is free to be rotated about a fulcrum 42. Engagement lever 40 is engageable with clutch lever 32 through a first engagement portion 40*a* and a second engagement portion 40*b*. When change lever 39 is displaced by its engagement with print head 22, engagement between one of the engagement portions 40*a* or 40*b* and clutch lever 32 is released so that change wheel 27 is free to rotate until clutch lever 32 engages a further engagement portion thereby stopping rotation of change wheel 25.

Operation of the print drive mechanism shown in FIGS. 5–8 will now be described. Referring specifically to FIGS. 5 and 6, rotation of drive shaft 24 which is always rotated in the direction of arrow I is transmitted to cylindrical cam 20. Rotation is transmitted through drive gear 25, small planet gear 33 rotated in the direction of arrow J, intermediate gear 35 rotated in the direction of arrow K and cam gear 21 fixed on cylindrical cam 20. Cylindrical cam 20 is rotated in the direction of arrow L and print head 22 is displaced along guide shaft 23 in the direction of arrow M as projection 22*a* follows spiral groove 20*a* in camming like fashion. As print head 22 is displaced in the direction of arrow M, print head 22 prints on recording paper 44 within the printing range.

As print head 22 is displaced in print direction M, clutch lever 32 is held in its first position out of engagement with clutch plate 26 by engagement of engaging portion 40*a* of engagement lever 40. When in this configuration, as shown in FIG. 6, rotation of change wheel 27 is suspended. As print head 22 enters out of the print range in print direction M, print head 22 engages first engaging arm 39*a* of change lever 39 located within the locus of print head 22. Change lever 39 is displaced in arrow M thereby pivoting engagement lever 40 in the direction of arrow N at the same time. When engagement lever 40 is rotated by more than a fixed angle in the direction of arrow N, clutch lever 32 is disengaged from engaging portion 40*a* of engagement lever 40. This disengagement permits release of clutch lever 32 which is then rotated about pin 28 in the direction of arrow O by a spring 43. Engaging tooth 32*a* of clutch lever 32 then engages clutch plate 26. Change wheel 27 is then engaged with drive shaft 24 through clutch plate 26 and change wheel 27 together with clutch lever 32 is rotated in the direction of arrow I. When change wheel 27 begins to rotate in arrow direction I, intermediate gear 35 is disengaged from cam gear 21 and cylindrical cam 20 stops rotating. At this time, print head 22, change lever 39 and engagement lever 40 are in a stand-by state as illustrated by a two-dot-line in FIG. 5.

Change wheel 27 continues to rotate in arrow direction I by drive shaft 24 through operations of clutch plate 26 and clutch lever 32. As rotation continues, first gear portion 27*a* of change wheel 27 engages paper feed gear 36 as shown in FIG. 7 and paper feed roller 37 thereby is rotated at a fixed angle for advancing recording paper 44. As change lever 27 continues rotating for about 180°, clutch lever 32 is engaged by the other engaging portion 40*b* of engagement lever 40 and begins to be returned to its first at rest position in arrow direction P against spring 43. This causes engaging tooth 32*a* to disengage from clutch plate 26 thereby bringing the members to a halt as shown in FIG. 8. At this time, change wheel 27 suspends rotation after being rotated through 180° from the previously suspended position illustrated in FIG. 5. At this time, cam gear 21 is engaged by large planet gear 34 as shown in FIG. 8 and the change of the rotating direction of cylindrical cam 20 is completed by operation of the rotary clutch assembly.

When the elements are in position as illustrated in FIG. 8, the rotating direction of drive shaft 24, which is always rotated in the direction of arrow I, is transmitted to cylindrical cam 20. This rotation in arrow direction I is transmitted through drive gear 25, large planet gear 34 which is rotated in the direction of arrow R and cam gear 21. Cam gear 21 is rotated in the direction of arrow S, contrary to the rotational direction illustrated in FIG. 6. Thus, print head 22 is displaced along guide shaft 23 in the direction of arrow T for printing on paper 44 within the printing range. When print head 22 is displaced to the end of the printing range, print head 22 engages second engaging arm 39*b* of change lever 39 which is in the position as illustrated by the two-dot-line in FIG. 5. At this time, change lever 39 is displaced in the direction of arrow T thereby causing engagement lever 40 to be rotated in the direction of arrow U.

When engagement lever 40 is rotated more than the fixed angle, clutch lever 32 is released from the engagement with clutch plate 26 and change wheel 27 begins to rotate in the direction of arrow I in the same manner as described with respect to changeover from rotating cam gear 21 in arrow direction L to rotating cam gear 21 in arrow direction S.

As the change wheel 27 begins to rotate further, large planet gear 34 is disengaged from cam gear 21 and cylindrical cam 20 stops rotating. At this time, print head 22, change lever 39 and engagement lever 40 come into the stand-by state. As change wheel 27 rotates, second gear portion 27*b* of change wheel 27 engages paper feed gear 36 and paper feed roller 37 is rotated by the fixed angle in the direction of arrow Q, as shown in FIG. 7, for advancing paper tape 44. When change wheel 27 has been rotated an additional 180° from the position illustrated in FIG. 8, it comes to rest as shown in FIG. 6 when cam gear 21 is engaged again with intermediate gear 35 and print head 22 commences to be displaced in the direction of arrow M as described above.

In a printer including a drive mechanism, as illustrated in FIGS. 5–8, print head 22 is displaced reversibly and includes a temporary suspension of displacement at both ends of the printing range. The printing of successive lines on recording paper 44 is made possible by repeating the printing operation which occurs while print head 22 is reversibly displaced with paper advancing occurring during the suspension of displacement of print head 22. In other words, paper advancing occurs when the direction of displacement of print head 22 is being changed.

Several advantages are obtained by constructing and arranging the drive mechanism for a printer in accordance with the preferred embodiment just described. First, the print head is forced into rectilinear reciprocating motion with inexpensive component parts without requiring a two speed motor. This reduces the manufacturing cost and extends the lifetime of the motor and the power consumption of the printer is also reduced. Second, since the print head displacement is suspended at the time of paper feeding, the load placed on the motor is reduced and the distance which the printer head need travel is also reduced. Therefore, there is less power consumed in further miniaturization and a high speed printer is achieved while avoiding the troublesome problems of paper feeding, such as a paper jam or wandering print are avoided. Third, as paper advance occurs when the print head is not being displaced, the overall distance of displacement is reduced leading to further reduction in size of the printer. It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer for printing on a print medium during displacement in at least one direction of a print head means across the print medium, comprising:

a frame;

cylindrical cam means rotatably mounted on said frame;

print head means for printing on said print medium slideably mounted on said frame and adapted to be displaced across said print medium in a first print direction in response to rotation of said cylindrical cam means in a first rotational direction and in an opposed second print direction in response to rotation of said cylindrical cam means in an opposed second rotational direction;

drive means rotating in one direction intermittently operatively engaged to said cylindrical cam means for rotating said cylindrical cam means in the two rotational directions; and clutch means for intermittently operatively coupling said drive means to said cylindrical cam means for rotating said cam means, said clutch means including reversing means for reversing direction of rotation of said cylindrical cam means when said cam means is at rest and not engaged to said drive means wherein said clutch means is a rotary clutch including a rotary member and clutch engaging means for intermittently operatively engaging said rotary member to said drive means for causing rotation of said rotary member, and holding means for engaging said clutch engaging means for holding said engaging means out of engagement with said drive means and holding said rotary member in at least two positions with said cam means in operative engagement with said drive means, said reversing means including gear means for rotating said cam means in two directions, said gear means mounted on said rotary member and engaged with said drive means and adapted to be intermittently engaged with said cylindrical cam means when said rotary member is held by said holding means, said gear means not engaged with said cylindrical cam means when said rotary member is intermittently rotated.

2. The printer of claim 1, wherein said gear means includes first planet gear means engaged with said drive means and engagable with said cylindrical cam means for rotating said cylindrical cam means in one of said rotational directions when said rotary member is held stationary by said holding means in one of said cam engaging positions, and second planet gear means engaged with said drive means and engageable with said cylindrical cam means for rotating said cylindrical cam means in the other rotational direction when said rotary member is held stationary by said holding means in another of said cam engaging positions.

3. The printer of claim 2, wherein said first and second planet gear means mounted on said rotary member for intermittently engaging said cam means to said drive means includes a first planet gear mounted on said rotary member and engaged with said drive means and engageable with said cylindrical cam means for rotating said cylindrical cam means in a first rotational direction for displacing said print head means in a first print direction, and said second planet gear means is a second planet gear and an intermediate gear mounted on said rotary member, said second planet gear engaged with said drive means and said intermediate gear, said intermediate gear engagable with said cylindrical cam means for rotating said cylindrical cam means in second rotational direction for displacing said print head means in the second print direction.

4. The printer of claim 3, wherein said first planet gear is larger than said second planet gear.

5. The printer of claim 4, wherein said first planet gear and said intermediate gear are mounted on the same diameter of said rotary member.

6. The printer of claim 1, wherein said clutch engaging means for operatively engaging said rotary member to said drive means includes clutch lever means held out of operative engagement with said drive means by said holding means, said clutch lever means actuated for rotating said rotary member when said print head means has completed displacement in one of said print directions across said print medium and said gear means are disengaged from said cam means for stopping rotation of said cam means.

7. The printer of claim 6, wherein said clutch lever means includes a clutch lever pivotally mounted on said rotary member and biased towards said drive means and adapted to be displaced from a first position out of engagement with said drive means to a second position in engagement with said drive means, said clutch lever held in said first position by said holding means and released from said first position to said second position in response to completion of displacement of said print head means in one of said print directions.

8. The printer of claim 7, wherein said drive means includes a drive shaft rotating in one direction and a clutch plate mounted thereon, said holding means being a holding lever pivotally mounted on said frame and intermittently engageable with said clutch lever for holding said clutch lever in its first position out of engagement with said drive shaft and said rotary member in a cam engaging position, said holding lever adapted to be released from engagement with said clutch lever in response to completion of displacement of the print head means across the print medium, and being displaced towards its second position towards said drive shaft for engaging said clutch plate causing rotation of said rotary member and removing said gear means from engagement with said cam means to stop displacement of said print head means.

9. The printer of claim 8, further including a change lever mounted on said frame and adapted to be displaced by said print head means at completion of displacement in said print directions, said change lever coupled to said holding lever for releasing engagement between said holding lever from said clutch lever upon completion of displacement of said print means in a print direction and for positioning said holding lever for engaging said clutch lever when said rotary member has rotated to another cam engaging position.

10. The printer of claim 9, wherein said holding lever is adapted to engage said clutch lever at two opposed positions of rotation of said rotary member.

11. The printer of claim 1, further including a change means mounted on said frame and coupled to said holding means, said change means adapted to be displaced by said print head means at completion of displacement in said print directions for releasing engagement between said holding means and said clutch engaging means and displacing said holding means into position for engaging said clutch engaging means when said rotary member has rotated to another cam engaging position.

12. The printer of claim 11, wherein said change means is an elongated change lever slideably mounted on said frame adjacent to said print head means and formed with a projecting arm at each end, said arm lying in the locus of displacement of said print head means for displacement by said print head means at the end of displacement in a print direction for displacing said holding means.

13. The printer of claim 1, including print medium advancing means for advancing the print medium when said cam means is not being rotated, said print medium advancing means mounted to said frame and intermittently operatively coupled to said drive means by said clutch means when said drive means is not engaged to said cylindrical cam means, thereby reducing the load on said drive means when said print medium is advanced thereby.

14. The printer of claim 13, wherein said print medium advancing means includes a print medium feed roller and feed roller gear mounted thereon and said rotary member includes at least two gear regions for engaging said feed roller gear when said rotary member is rotated from one cam engaging position to another cam engaging position and said drive means is not engaged to said cam means.

15. The printer of claim 14, wherein said two gear regions are opposed on said rotary member 180° apart.

16. The printer of claims 5, 10 or 15 wherein said cylindrical cam means includes a cylindrical cam mounted on said frame and formed with a spiral groove and said print head means is adapted to engage said groove for effecting displacement of said print head means.

17. The printer of claim 15, including a cam gear mounted on said cylindrical cam for engaging the first planet gear of said first planet gear means and the intermediate gear of said second planet gear means.

18. The printer of claim 16, wherein said spiral groove is an open-looped spiral groove.

19. A printer for printing on a print tape during displacement in at least one direction of a print head across the print tape comprising:

a frame;

a cylindrical cam having a spiral groove thereon rotatably mounted on said frame;

a printer head slideably mounted on said frame, said printer head including a projection for engaging said spiral groove in camming fashion, said print head adapted to be displaced across said print tape in a first print direction in response to rotation of said cylindrical cam in a first rotational direction and in an opposed second print direction in response to rotation of said cylindrical cam in an opposed second rotational direction;

drive means including a drive shaft rotating in one direction;

rotary clutch means for intermittently operatively coupling said drive shaft to said cylindrical cam for rotating the cam when in one of two cam engaging positions, said clutch means including a clutch plate mounted on said drive shaft and a rotary member mounted for rotation about said drive shaft;

engaging means for intermittently engaging said rotary member to said clutch plate for rotation of said rotary member, a first planet gear mounted on said rotary member engaged to said drive gear and engageable with said cam when said rotary member is in one cam engaging position for rotating said cam in a first rotational direction, a second planet gear and an intermediate gear, said second planet gear engaged with said drive gear and said intermediate gear, said intermediate gear engageable with said cam when said rotary member is in the second cam engaging position for rotating said cam in a second rotational direction, and holding means for holding said engaging means out of engagement with said clutch plate and said rotary member in said cam engaging positions for rotating said cam in one of two rotational directions for displacing said print head in said printing directions.

20. The printer of claim 19, further including a paper feed roller having a feed gear mounted thereon and said rotary member including two opposed geared regions adapted to engage said feed gear when said rotary member is rotated from one of said cam engaging positions to the other of said cam engaging positions for advancing said paper when the planet gears are disengaged from said cylindrical cam.

21. The printer of claims 19 or 20, wherein said engaging means includes a clutch lever pivotally mounted on said rotary member and biased towards said clutch plate and engageable with said clutch plate for transmitting the rotation of said clutch plate to said rotary member, said holding lever engaged with said clutch lever for holding said clutch lever in a first position out of engagement with said clutch plate when said rotary member is in a cam engaging position with one of said planet gears engaged with said cam, said holding lever disengageable from said clutch lever for pivoting said clutch lever to a second position in engagement with said drive gear for rotation of said rotary member from one of said cam engaging positions to the other of said cam engaging positions, said holding lever engaging said clutch lever after said rotary member has rotated to the other cam engaging position for reversal of direction of rotation of the cylindrical cam.

22. The printer of claim 21, including a change lever mounted on the frame and coupled to said holding lever, said change lever adapted to be displaced by the printer head at completion of displacement across the print tape for releasing engagement between said holding lever and clutch lever in one cam engaging position and placing said holding lever in the other cam engaging position for holding the clutch lever after rotation of said clutch plate.

* * * * *